US005187500A

United States Patent [19]

Bohorquez et al.

[11] Patent Number: 5,187,500

[45] Date of Patent: Feb. 16, 1993

[54] CONTROL OF ENERGY TO THERMAL INKJET HEATING ELEMENTS

[75] Inventors: Jaime H. Bohorquez, Escondido; Brian J. Keefe, La Jolla, both of Calif.

[73] Assignee: Hewlett-Packard Company, Palo Alto, Calif.

[21] Appl. No.: 577,911

[22] Filed: Sep. 5, 1990

[51] Int. Cl.[5] ..... B41J 2/05

[52] U.S. Cl. ..... 346/140 R; 346/76 PH

[58] Field of Search ..... 346/140 R, 76 PH

[56] References Cited

U.S. PATENT DOCUMENTS

| | | | |
|---|---|---|---|
| 4,322,733 | 3/1982 | Moriguchi et al. | 346/76 PH |
| 4,327,365 | 8/1982 | Noda | 346/76 PH |
| 4,573,058 | 2/1986 | Brooks | 346/76 PH |
| 4,746,935 | 5/1988 | Allen | 346/140 |
| 4,809,428 | 3/1989 | Aden et al. | 29/611 |
| 4,862,197 | 8/1989 | Stoffel | 346/140 R |
| 4,875,056 | 10/1989 | Ono | 346/76 PH |
| 4,926,197 | 5/1990 | Childers et al. | 346/140 R |

FOREIGN PATENT DOCUMENTS

| | | | |
|---|---|---|---|
| 0188674 | 11/1983 | Japan | 346/76 PH |
| 0039568 | 3/1984 | Japan | 346/76 PH |
| 0148678 | 8/1984 | Japan | 346/76 PH |
| 0155068 | 9/1984 | Japan | 346/76 PH |

OTHER PUBLICATIONS

"The Thinkjet Orifice Plate: A Part With Many Functions", Gary L. Siewell, William R. Boucher, and Paul H. McClelland, May 1985 Hewlett-Packard Journal, pp. 33-37.

"Development of the Thin-Film Structure for the ThinkJet Printhead", Eldurkar V. Bhaskar and J. Stephen Aden, May 1985 Hewlett-Packard Journal, pp. 27-33.

"The Second-Generation Thermal InkJet Structure", Ronald A. Askeland, Winthrop D. Childers, and William R. Sperry, Aug. 1988 Hewlett-Packard Journal, pp. 28-31.

"Integrating the Printhead into the HP DeskJet Printer", J. Paul Harmon and John A. Widder, Oct. 1988 Hewlett-Packard Journal, pp. 62-66.

*Primary Examiner*—Benjamin R. Fuller
*Assistant Examiner*—Alrick Bobb

[57] ABSTRACT

A thermal ink jet printhead including a substrate, a resistor layer on the substrate having ink drop firing resistors and energy controlling resistors defined therein, a metallization layer adjacent the resistor layer and having metallic interconnections formed therein for providing serial energy controlling connections between predetermined ones of the ink drop firing resistors and predetermined ones of the energy controlling resistors, a plurality of ink containing chambers respectively formed over the metallization layer adjacent respective ones of the ink drop firing resistors, and an orifice plate secured over the chambers and containing a plurality of nozzles respectively associated with the chambers.

5 Claims, 2 Drawing Sheets

CONTROL OF ENERGY TO THERMAL INKJET HEATING ELEMENTS

BACKGROUND OF THE INVENTION

The subject invention relates generally to thermal ink jet printers, and is directed more particularly to a technique for reducing drive energy in thermal ink jet printheads while maintaining consistently high print quality.

Thermal ink jet printers utilize thermal ink jet printheads that comprise an array of precision formed nozzles, each of which is in communication with an associated ink containing chamber that receives ink from a reservoir. Each chamber includes an ink drop firing resistor which is located opposite the nozzle so that ink can collect between the ink drop firing resistor and the nozzle. The ink drop firing resistor is selectively heated by voltage pulses to drive ink drops through the associated nozzle opening in the orifice plate. Pursuant to each pulse, the ink drop firing resistor is rapidly heated, which causes the ink directly adjacent the thermal resistor to vaporize and form a bubble. As the vapor bubble grows, momentum is transferred to the ink between the bubble and the nozzle, which causes such ink to be propelled through the nozzle and onto the print media.

For ease of replacement of thermal printheads which eventually wear out, thermal printheads are often implemented as printhead cartridges comprising a thermal printhead and an ink reservoir. With such implementation, printhead driver circuitry is connected to the printhead cartridge by appropriate contacting components. An example of a thermal ink jet printhead cartridge is disclosed in "The second-Generation Thermal InkJet Structure," Askeland et al, HEWLETT-PACKARD JOURNAL, August 1988, pages 28-31.

Further background information on thermal inkjet printheads and/or the manufacture thereof can be found in commonly U.S. Pat. Nos. 4,746,935 and 4,809,428, and in the following publications: "Development of the Thin-Film Structure for the ThinkJet Printhead," Eldurkar V. Bhasker and J. Stephen Aden, HEWLETT-PACKARD JOURNAL, May 1985, pages 27-33; "Integrating the Printhead into the HP DeskJet Printer," J. Paul Harmon and John A. Widder, HEWLETT-PACKARD JOURNAL, October 1988, pages 62-66; and "The Think Jet Orifice Plate: A Part with Many Functions," Siewell et al., *Hewlett-Packard Journal,* May 1985, pages 33-37.

A consideration with thermal ink jet printers that utilize modular printhead cartridges is that the printhead driver circuitry commonly provides ink drop firing signals having generally constant energy to the ink drop generators of the printhead. However, different ink drop generator configurations and different inks may have different ink drop firing energy requirements. For example, an ink drop generator configured to produce smaller ink drops requires less energy for firing, and too much energy can cause improper operation. Also, a given printhead can have ink drop generators that are configured to provide respectively different ink drop volumes, for example, as disclosed in the above-referenced U.S. Pat. No. 4,746,935. Further, newly developed or revised printheads could have ink drop firing energy requirements that are different from those for which existing thermal ink jet printers have been configured.

SUMMARY OF THE INVENTION

It would therefore be an advantage to provide a thermal ink jet printhead which includes circuitry for controlling energy provided to the ink drop firing resistors.

The foregoing and other advantages are provided by the invention in a thermal ink jet printhead that includes a substrate, a resistor layer on the substrate having ink drop firing resistors and energy controlling resistors defined therein, a metallization layer adjacent the resistor layer and having metallic interconnections formed therein for providing serial energy controlling connections between predetermined ones of the ink drop firing resistors and predetermined ones of the energy controlling resistors, a plurality of ink containing chambers respectively formed over the metallization layer adjacent respective ones of the ink drop firing resistors, and an orifice plate secured over the chambers and containing a plurality of nozzles respectively associated with the chambers.

BRIEF DESCRIPTION OF THE DRAWING

The advantages and features of the disclosed invention will readily be appreciated by persons skilled in the art from the following detailed description when read in conjunction with the drawing wherein.

DETAILED DESCRIPTION OF THE DISCLOSURE

Figure 1:
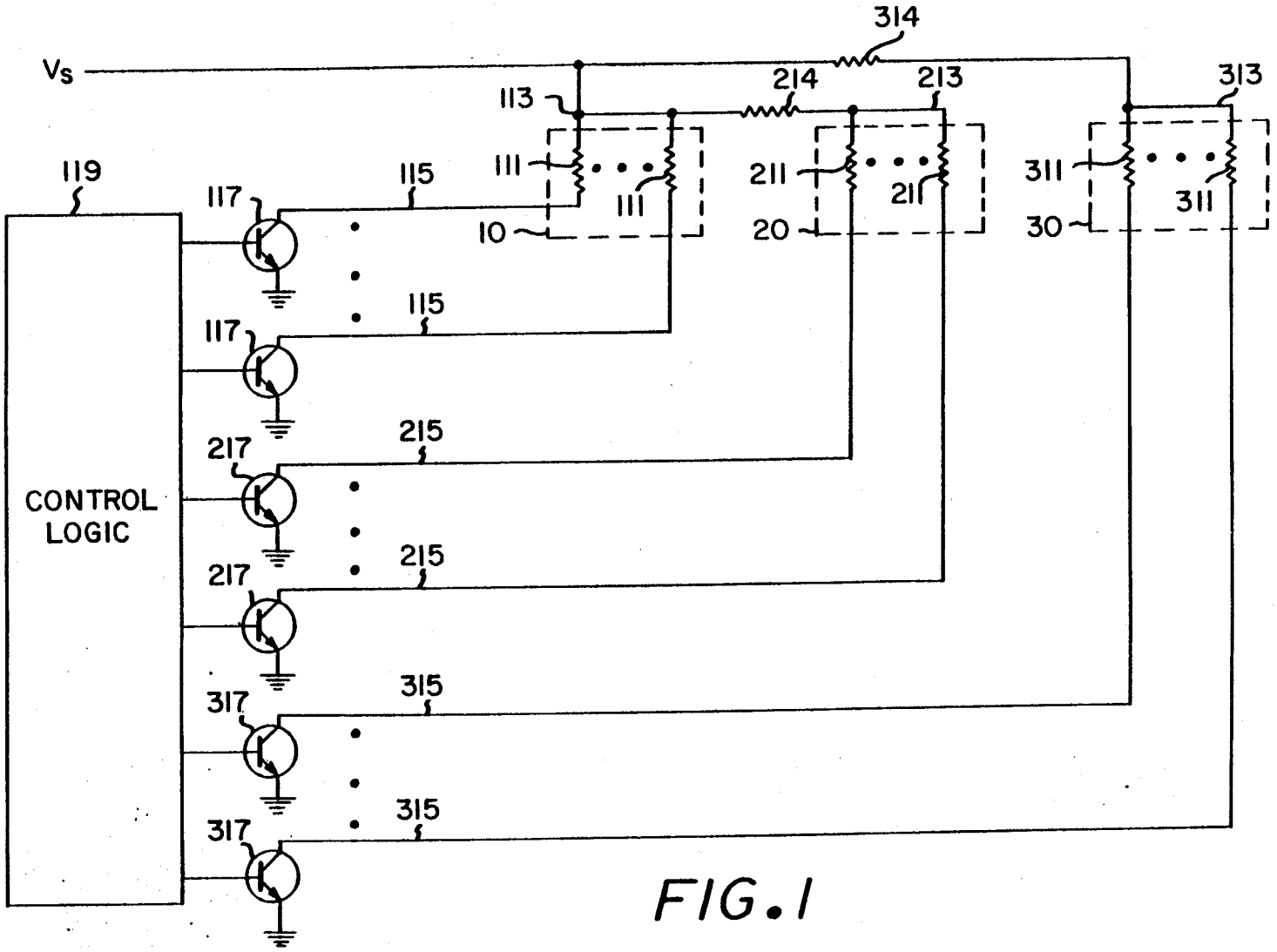
FIG. 1 is a circuit diagram of a thermal printhead in accordance with the invention.

In the following detailed description and in the several figures of the drawing, like elements are identified with like reference numerals.

Referring now to FIG. 1, shown therein is a circuit schematic of the ink firing circuitry of a thermal ink jet printhead having three groups 10, 20, 30 of ink firing resistors. The first resistor group 10 includes ink firing resistors 111 which form part of a first group of ink drop generators having substantially identical physical and electrical properties. The first leads of the ink firing resistors 111 of the first resistor group 10 are commonly connected to a first primitive supply node 113 that is connected to a supply $V_s$. The second leads of the ink firing resistors 111 of the first resistor group 10 are respectively connected to respective control nodes 115. The respective control nodes 115 are connected to respective switching circuitry 117, schematically shown as transistors, which are controlled by a control logic circuit 119 to connect the control node of a selected ink firing resistor to ground.

The second resistor group 20 includes ink firing resistors 211 that comprise part of a second group of ink drop generators having substantially identical physical and electrical properties. The second group of drop generators can have physical and electrical properties different from those of the first group of ink drop generators, whereby the energy requirements of the second group ink drop generators can be different from those of the first group. For example, the second group can have different physical and/or electrical properties to produce a different ink drop volume or to use an ink having different characteristics. Such different properties can be provided for purposes such as greyscale printing, multiple dot size high resolution printing, multi-color or multi-concentration ink, changes to ink formulation after commercial introduction of the thermal printhead, and maximizing printing quality on special media.

The first leads of the ink firing resistors 211 of the second resistor group 20 are commonly connected to a second primitive supply node 213, and an energy controlling resistor 214 is connected between the second primitive supply node 213 and the first primitive supply node 113. The second leads of the ink firing resistors 211 are connected to respective control nodes 215, which are connected to respective switching circuitry 217, schematically shown as transistors. The switching circuitry 217 are controlled by the control logic circuit 119 to connect the control node 215 of a selected ink firing resistor 211 to ground.

The third resistor group 30 includes ink firing resistors 311 that comprise part of a third group of ink drop generators having substantially identical physical and electrical properties. The physical and electrical properties of the third group of ink drop generators can be different from those of the first group and/or second group of ink drop generators, whereby the energy requirements of the third group ink drop generators can be different from those of the first group and/or the second group. For example, the third group can have different physical and/or electrical properties to produce a different ink drop volume or to use an ink having different characteristics. Examples of reasons for having such different properties are identified above relative to the properties of the second group of drop generators.

The first leads of the ink firing resistors 311 of the third resistor group 30 are commonly connected to a third primitive supply node 313, and an energy controlling resistor 314 is connected between such third primitive supply node 313 and the first primitive supply node 113. The second leads of the ink firing resistors 311 are connected to respective control nodes 315, which are connected to respective switching circuitry 317, schematically shown as transistors. The switching circuitry 317 are controlled by the control logic circuit 119 to connect the control node 315 of a selected ink firing resistor 311 to ground.

Typically, only one ink firing resistor can be driven at any given time pursuant to connection of one selected control node to ground for a predetermined pulse interval. The switching circuit associated with the selected ink firing resistor is activated, which grounds the control node connected to the second lead of the selected resistor and causes the voltage at the associated primitive supply node to be applied across the selected ink firing resistor. Since only one ink firing resistor is fired at any given time, the circuit completed by the grounded control node includes only the selected ink firing resistors and any energy controlling resistor connected thereto. If the selected ink firing resistor is in a group that includes an energy controlling resistor, such energy controlling resistor is in series with the selected ink firing resistor and thus controls the energy provided to that ink firing resistor. The non-selected ink firing resistors are not affected since their control nodes comprise open circuits.

The thermal ink jet printhead of the invention is advantageously implemented in a thin film structure wherein the energy controlling resistors are formed with the same steps and with the same layers of material as utilized for the formation of the ink firing resistors. In such implementation, the control nodes and the first primitive supply node (which is connected directly to the first resistor group and via energy controlling resistors to the second and third resistor group) include metallic contacts for external connections, and the connections between such nodes and the resistors comprise appropriately formed metallization.

Figure 2:
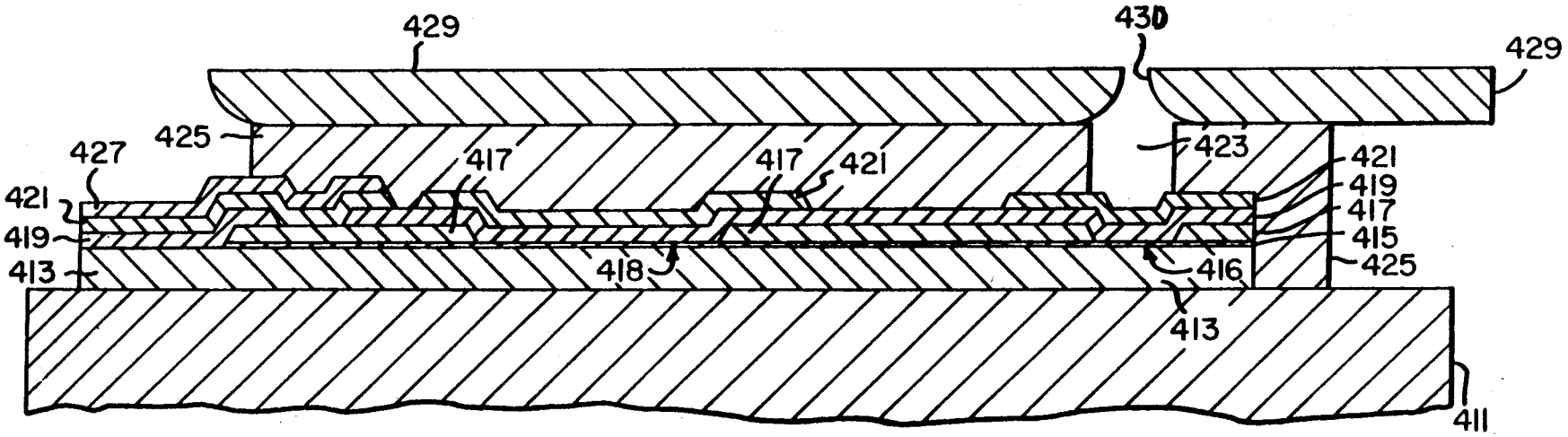
FIG. 2 is a cross-sectional view of a thin film embodiment of a thermal ink jet printhead in accordance with the invention.

Referring in particular to FIG. 2, shown therein is an unscaled cross-sectional view of one of the ink drop generators of a thin film embodiment of a thermal ink jet printhead in accordance with the invention. It includes a substrate 411, comprising silicon or glass, for example, and a thermal barrier or capacitor layer 413 disposed thereon. A resistive layer 415 comprising tantalum aluminum is formed on the thermal barrier extending over areas that will be beneath the ink firing nozzle structures. A metallization layer 417 comprising aluminum doped with a small percentage of copper, for example, is disposed over the resistor layer 415. The resistive layer 415 and the metallization layer 417 do not extend to the edges of the substrate which underlie interconnection pads 427, described further herein.

The metallization layer 417 comprises metallization traces defined by appropriate masking and etching. The masking and etch of the metallization layer 417 also defines the resistor areas. In particular, instead of masking and etching of the resistive layer 415, a resistor is formed for a given conductive path by providing a gap in the metallic trace at the location of the resistor area, so as to force the conductive path to include a portion of the resistive layer 415 located at the gap in the conductive trace. Stated another way, a resistor area is defined by providing first and second metallic traces that terminate at different locations on the perimeter of the resistor area. The first and second traces comprise the terminal or leads of the resistor which effectively include a portion of the resistive layer that is between the terminations of the first and second traces.

Resistor areas are defined for ink firing resistors 416 and energy controlling resistors 418.

A first passivation layer 419 comprising silicon carbide and silicon nitride, for example, is disposed over the metallization layer 417, the exposed portions of the resistive layer 415, and exposed portions of the thermal barrier layer 413 at the edges of the substrate.

A second passivation layer 421 comprising tantalum is disposed over the first passivation layer 419 in areas that overlie the ink firing resistors 416 and the energy controlling resistors 418, and also over the first passivation layer 419 at the edges of the substrate. Since the tantalum passivation layer 421 overlies the ink firing resistors, it forms the bottom walls of ink containing chambers 423 that overlie the ink firing resistors 416. The second passivation layer 421 at the edges of the substrate contact the metallization layer 417 through appropriate vias in the first passivation layer. The ink containing chambers 423 are further defined by an appropriate ink barrier layer 425 having openings formed therein and exposing the tantalum passivation layer 421.

A layer of gold areas 427 are disposed on the second passivation layer 421 at the edges of the substrate, and form interconnection pads that are conductively connected to the metallization layer by the second passivation layer areas at the edges of the substrate.

An orifice plate 429 having nozzle openings 430 for the respective ink chambers 423 is disposed on the ink barrier layer 425.

The tantalum passivation layer 421 provides mechanical passivation to the ink firing resistors by absorbing the cavitation pressure of the collapsing drive bubble, provides an adhesion layer for the gold areas, and further provides extra mechanical toughness to the interconnect pads at the edges of the substrate. For the energy controlling resistors, the tantalum passivation layer advantageously provides a low thermal resistance path for heat dissipation. A lower, more stable local operation temperature of the energy controlling resistors provides for more consistent control by minimizing change in resistivity due to temperature variation. It is noted that openings in the ink barrier layer 425 over the energy controlling resistors can be provided to permit radiant heat to transfer to the orifice plate 429.

Figure 3:
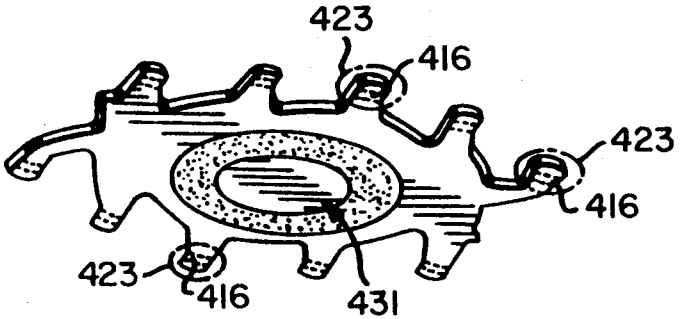
FIG. 3 is a schematic perspective view showing the resistor areas and ink chamber areas for a group of ink drop generators that would normally be covered by a nozzle orifice plate.

Referring now to FIG. 3, shown therein is a schematic perspective view delineating the resistor areas 416 and the ink chambers 423 for a group of ink jet nozzle structures that would be covered by a nozzle orifice plate. Ink is supplied to the ink chambers 423 through a hole 431, formed by laser drilling or sand blasting, for example, that passes through the substrate and the layers disposed thereon. By way of illustrative example, the resistor areas 416 shown in FIG. 3 as being associated with a common ink feed comprise the resistors for one of the resistor groups of the printhead circuit schematic of FIG. 1.

The thin film implementation of the invention is readily produced pursuant to standard thin film techniques including chemical vapor deposition, photoresist deposition, masking, developing, and etching. The orifice plate is formed pursuant to known electroforming processes which are adaptations of electroplating. Processing examples and considerations are set forth in the references identified in the preceding background section.

While the foregoing implementation of the invention locates a energy controlling resistor in the common return path for the drop generators of an ink firing resistor group, energy controlling resistors can be provided with other configurations. For example, energy controlling resistors can be provided separately for the ink firing resistors as required. It should be noted, however, that the use of an energy controlling resistor in a common return provides the advantages of utilizing less integrated circuit die area and reduction of adverse thermal effects. In particular, an energy controlling resistor in the common return path may conveniently be made large enough to maintain low maximum local operating temperatures and to avoid thermal effects on nominal resistance. Further, a common energy controlling resistor can be conveniently located far from the firing resistors so as to reduce its effect on local substrate temperature around the drop generator regions of the integrated circuit die. In implementations where each ink firing resistor has separate driving circuitry, then respective energy controlling resistors would have to be provided for each ink firing resistor.

The foregoing has been a disclosure of a thermal ink jet printhead structure that provides different energy levels to the heating elements of a printhead system that could include one printhead or a plurality of printheads, and which does not require additional manufacturing steps. By controlling the energy levels provided to the heating elements, performance and reliability are improved, and operational sensitivities are reduced. Pursuant to the disclosed printhead structure, new printhead designs having different energy requirements are readily implemented for use on existing products without reconfiguring such existing products, and the design of future products is simplified since different energy requirements can be compensated.

Although the foregoing has been a description and illustration of specific embodiments of the invention, various modifications and changes thereto can be made by persons skilled in the art without departing from the scope and spirit of the invention as defined by the following claims.

What is claimed is:

1. An integrated thermal ink jet printhead comprising:

a substrate;

a resistor layer on said substrate having ink drop firing resistors of different energy requirements and energy controlling resistors defined therein;

a metallization layer adjacent said resistor layer and having metallic interconnections formed therein for providing serial energy controlling connections between predetermined ones of said ink drop firing resistors and predetermined ones of said energy controlling resistors so as to control the energy provided to said predetermined ones of said energy controlling resistors in accordance with the energy requirements thereof;

a plurality of ink containing chambers respectively formed over said metallization layer adjacent respective ones of said ink drop firing resistors; and an orifice plate secured over said chambers and containing a plurality of nozzles respectively associated with said chambers;

wherein said ink drop firing resistors are organized into resistor groups having respective common nodes, the resistors in a group having substantially the same energy requirements, and wherein each of said common nodes can have an energy controlling resistor connected thereto, whereby the energy provided to each of the resistors in a group is controlled by the energy controlling resistor in a return circuit for that group.

2. The thermal ink jet printhead of claim 1 wherein said ink drop firing resistors and said energy controlling resistors comprise a same material.

3. The thermal ink jet printhead of claim 1 wherein said resistor layer comprises a tantalum aluminum layer and wherein said ink jet firing resistors and said energy controlling resistors are defined by metallization contacts at selected locations on said tantalum aluminum layer.

4. The thermal ink jet printhead of claim 1 further including a tantalum layer disposed over said energy controlling resistors and over said ink firing resistors, whereby said layer provides for dissipation of heat from said energy controlling resistors and for mechanical passivation for said ink firing resistors.

5. The thermal ink jet printhead of claim 1 wherein said energy controlling resistors are located away from said ink firing resistors so as to reduce thermal effect of said energy controlling resistors on the integrated circuit regions adjacent said ink firing resistors.

* * * * *